US006317086B1

(12) United States Patent
Woo

(10) Patent No.: US 6,317,086 B1
(45) Date of Patent: Nov. 13, 2001

(54) EXTENDIBLE AND CONTRACTIBLE WIRELESS ANTENNA

(75) Inventor: Min-Jae Woo, Suwon (KR)

(73) Assignee: MRW Technologies Ltd., Seoul (KR)

( * ) Notice: Subject to any disclaimer, the term of this patent is extended or adjusted under 35 U.S.C. 154(b) by 0 days.

(21) Appl. No.: 09/493,835

(22) Filed: Jan. 28, 2000

(30) Foreign Application Priority Data

Feb. 1, 1999 (KR) ..... 99-3245

(51) Int. Cl.[7] ..... H01Q 1/24
(52) U.S. Cl. ..... 343/702; 455/90
(58) Field of Search ..... 343/702, 895, 343/900; 455/90

(56) References Cited

U.S. PATENT DOCUMENTS

| | | | | |
|---|---|---|---|---|
| 4,868,576 | | 9/1989 | Johnson, Jr. | 343/702 |
| 5,258,772 | * | 11/1993 | Inanaga et al. | 343/895 |
| 5,479,178 | * | 12/1995 | Hu | 343/702 |
| 5,612,704 | | 3/1997 | Cole | 343/702 |
| 5,825,330 | | 10/1998 | Na et al. | 343/702 |
| 5,861,859 | * | 1/1999 | Kanayama et al. | 343/895 |
| 6,112,102 | * | 8/2000 | Zhinog | 455/550 |

FOREIGN PATENT DOCUMENTS 0516490 12/1992 (EP) .

* cited by examiner

*Primary Examiner*—Don Wong
*Assistant Examiner*—James Clinger
(74) *Attorney, Agent, or Firm*—Baker Botts LLP

(57) ABSTRACT

Disclosed is an antenna of a wireless apparatus which comprises an antenna housing fixed on an outer upper part of the wireless apparatus main body; a feeding connector installed in a lower part of the antenna housing and electrically connected to a circuit built in the wireless apparatus main body; a helical antenna including a helical coil built in the antenna housing and electrically disconnected from the feeding connector; and a rod antenna moving up and down through the feeding connector and the helical antenna, wherein when the rod antenna is contracted into the wireless apparatus, the helical antenna is electrically connected to the feeding connector and the rod antenna is electrically disconnected from the feeding connector, and when the rod antenna is extended outside of the wireless apparatus, the rod antenna is electrically connected to the feeding connector and the helical antenna is electrically disconnected from the feeding connector.

14 Claims, 6 Drawing Sheets

EXTENDIBLE AND CONTRACTIBLE WIRELESS ANTENNA

BACKGROUND OF THE INVENTION (a) Field of the Invention

The present invention relates to an antenna that comprises a helical antenna installed on an outer upper part of a portable wireless apparatus, and a rod antenna that passes through an inner part of the helical antenna and is extendable to the outside of the wireless apparatus and contractible inside of the wireless apparatus. More specifically, the present invention relates to an antenna in which a helical antenna transmits and receives radio frequency (RF) signals when a rod antenna is contracted, and the helical antenna can be separated from a feeding connector of the antenna apparatus and the rod antenna can become free from any coupling effects with the helical antenna and can transmit and receive RF signals when the rod antenna is extended.

(b) Description of the Related Art

Generally, the portable wireless apparatus adopts a fixable type helical antenna, an extendible and contractible antenna in which a helical antenna is fixed on an upper part of a rod antenna in one unit, or an extendible and contractible antenna in which a helical antenna is fixed on an outer upper part of a wireless apparatus with a rod antenna passing through an inner part of the helical antenna and extending and contracting from and into the wireless apparatus.

A fixable antenna conventionally comprises a helical antenna having wave length of $\lambda/2$ or $\lambda/4$. Since the physical length of the antenna is far shorter than $1\lambda$, the helical antenna has drawbacks of a narrow bandwidth and low radiation efficiency.

To overcome the problems that the fixable antenna has and to provide for the portability of the wireless apparatus, the above-noted two extendible and contractible antennas have been developed and are widely used.

A European patent No. 0516490 discloses a contractible antenna in which a helical antenna is fixed on an upper part of a rod antenna as an integrated unit. When the rod antenna is contracted, the helical antenna is coupled to a feeding line of the wireless apparatus in order to operate, and when the rod antenna is extended, the rod antenna is coupled to the feeding line of the wireless apparatus while the helical antenna is disconnected from the feeding line. Since the center of gravity of the antenna becomes positioned at the helical antenna that is fixed on the upper part of the rod antenna in an integrated unit when the rod antenna is extended, if the user drops the wireless apparatus on the ground, a plastic joint which couples the helical antenna with the rod antenna c an b e easily broken.

The U.S. Pat. No. 4,868,576 discloses an extendible and contractible antenna comprises an antenna housing with a built-in helical antenna, being fixed on the outer upper part of the wireless apparatus; and a rod antenna which passes through the inner part of the helical antenna which is extended and contracted. When contracted, an insulated portion of the upper part of the rod antenna in the extendible and contractible antenna is positioned in the inner part of the helical antenna, and thereby, only the helical antenna works. When extended, the helical antenna and the rod antenna must be coupled in a capacitive manner while the helical antenna is coupled to the feeding line of the wireless apparatus. For this capacitive coupling, the helical antenna and the rod antenna have to be precisely matched.

U.S. Pat. Nos. 5,612,704 and 5,825,330 were disclosed to solve the above-noted problem. In the case of extension of the rod antenna, a portion of a lower part of the rod antenna contacts the helical antenna, and therefore, the helical antenna is electrically disconnected, which is referred to as the short circuit method. In order to achieve these electrical characteristics, the helical antenna must directly contact the rod antenna, and in this case, the helical antenna or rod antenna may be changed in its form. This may cause dangerous modification of the characteristics of the antenna and also requires high precision in the manufacture of the antennas.

SUMMARY OF THE INVENTION

It is an object of the present invention to provide an apparatus for a helical antenna to independently receive and transmit signals in a portable wireless apparatus, and for a rod antenna to independently receive and transmit the signals without coupling to the helical antenna when making or receiving a call so that coupling between the helical antenna and the rod antenna is prevented, and to simplify the design and manufacture of the antenna.

In one aspect of the present invention, an antenna of wireless apparatus comprises an antenna housing fixed on an outer upper part of the wireless apparatus main body; a feeding connector installed in a lower part of the antenna housing and electrically connected to a circuit built in the wireless apparatus main body; a helical antenna including a helical coil built in the antenna housing and electrically disconnected from the feeding connector; and a rod antenna moving up and down through the feeding connector and the helical antenna, wherein when the rod antenna is contracted into the wireless apparatus, the helical antenna is electrically connected to the feeding connector and the rod antenna is electrically disconnected from the feeding connector, and when the rod antenna is extended outside of the wireless apparatus, the rod antenna is electrically connected to the feeding connector and the helical antenna is electrically disconnected from the feeding connector.

The helical antenna is electrically disconnected because of an insulation pad positioned between the helical antenna and the feeding connector.

An upper part of the rod antenna with a predetermined length is wrapped with an insulating material.

A center part of the predetermined length of the rod antenna is a conductive metallic core rod or a conductive metallic core rod wrapped with a conductive covering material.

A lower part of a predetermined length of the rod antenna is a metallic core rod wrapped with an insulation covering material.

The antenna further comprises an end terminal stopper which stops the rod antenna on a cylindrical spring installed in the feeding connector when the rod antenna is extended, and electrically connects the rod antenna with the feeding connector.

The antenna fixes the helical antenna on the antenna housing, and electrically connects the rod antenna with the feeding connector, or the helical antenna with the feeding connector when the rod antenna which comprises a cylindrical spring, plate spring, or a fang spring is extended or contracted.

A conductive ring is further installed at a predetermined position of the insulation pad of the rod antenna so that when the rod antenna is contracted into the wireless apparatus, the helical antenna is electrically connected to the feeding connector.

The rod antenna is contracted into the wireless apparatus, an upper insulated part of the rod antenna passes through the helical antenna and the feeding connector so that the rod antenna is electrically disconnected from the feeding connector.

When the rod antenna is extended, a lower part of the rod antenna that is wrapped with an insulation covering material passes through the helical antenna and the feeding connector so that the helical antenna and the rod antenna are electrically insulated from each other.

Additionally, when the rod antenna is extended, the end terminal stopper and the feeding connector installed below the rod antenna are also electrically connected.

Furthermore, when the rod antenna is extended, the conductive ring also moves from a predetermined position of the contracted state and disconnects the helical antenna from the feeding connector.

The helical antenna is connected to the feeding connector in a capacitive manner or through other coupling manners.

When the rod antenna is contracted, the helical antenna and the feeding connector are electrically connected with the conductive ring.

Additionally, when the rod antenna is contracted, the helical antenna and the feeding connector are electrically connected with the conductive ring.

The helical antenna comprises a helical antenna for dual band or multi-bands antennas.

The rod antenna covers a rod type copper line that is coated with silver, ultra-elastic nickel titanium wire, and a rod type coil spring.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

In the following detailed description, only the preferred embodiment of the invention has been shown and described, simply by way of illustration of the best mode contemplated by the inventor(s) of carrying out be invention. As will be realized, the invention is capable of modification in various obvious respects, all without departing from the invention. Accordingly, the drawings and description are to be regarded as illustrative in nature, and not restrictive.

Figure 1:
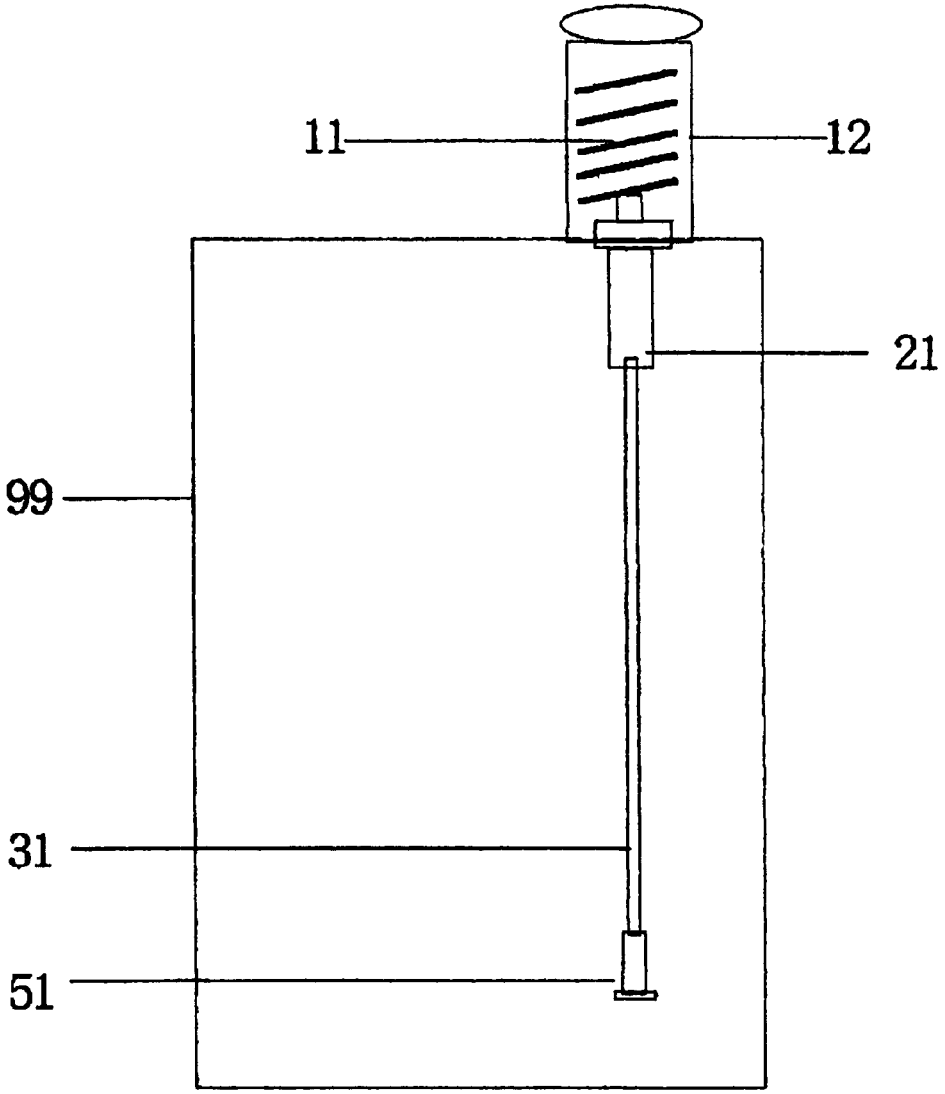
FIG. 1 is a schematic diagram of a contracted portable wireless apparatus antenna.

FIG. 1 is a schematic diagram of a contracted portable wireless apparatus antenna.

This extendible and contractible wireless apparatus antenna comprises an antenna housing 12 which is fixed on an outer upper part of the wireless apparatus main body 99; a helical antenna 11 which is installed in an inner part of the antenna housing 12 as a spiral form and which operates in a receiving standby mode; a feeding connector 21 which fixes the antenna housing on the wireless apparatus main body 99 and is concurrently electrically coupled to a circuit installed in the wireless apparatus main body 99 and which also includes a spring (not illustrated); and a rod antenna 31 which passes through the inner part of the helical antenna and contracts into the inner part of the wireless apparatus main body 99 and extends to the exterior of the wireless apparatus main body 99 and also operates in the transmitting and receiving modes during a call The antenna housing 12 with the built-in helical antenna 11 is fixed on one end of the outer upper part of the wireless apparatus main body 99 by the feeding connector 21. At this time, the feeding connector 21 continues to maintain an electrical connection with a circuit installed in the wireless apparatus main body 99. Also, when the rod antenna 31 is contracted, the helical antenna 11 and the feeding connector 21 are electrically connected by a metallic conductive ring 52 shown in FIG. 6. While on the other hand, since the rod antenna 31 is wrapped with the insulation covering material 32, the rod antenna 31 is electrically disconnected from the feeding connector 21, only the helical antenna functions as an antenna that transmits and receives RF signals.

Figure 2:
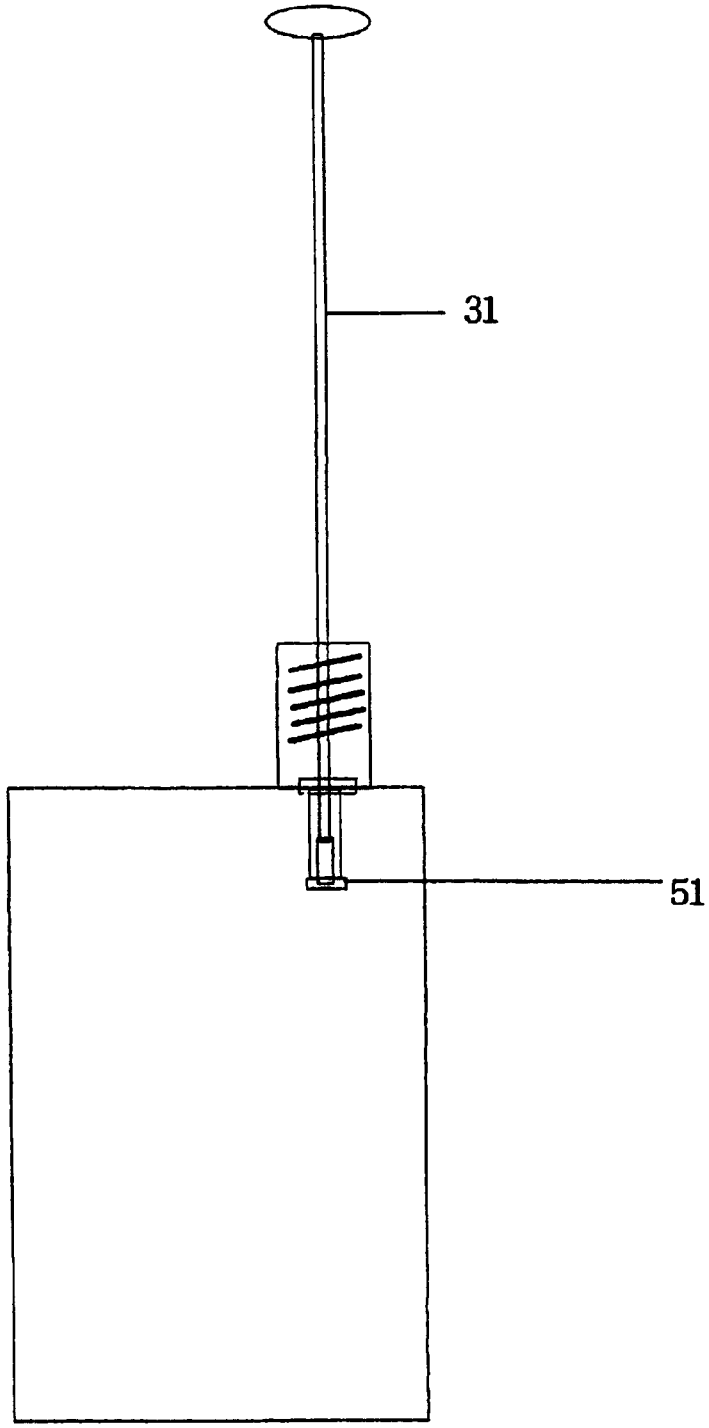
FIG. 2 is a schematic diagram of an extended portable wireless apparatus antenna.

FIG. 2 shows a simplified diagram of a portable wireless apparatus with an extended antenna. The rod antenna 31 is extended to the exterior of the wireless apparatus main body 99, and accordingly, the metallic conductive ring 52 (indicated in FIG. 6) which connects the helical antenna 11 and the feeding antenna 21 is displaced. As a result, the helical antenna 11 is electrically disconnected from the feeding connector 21 and the helical antenna 11 does not operate. On the other hand, when the metallic end terminal 51 installed in the lower end of the rod antenna 31 is contacts the spring of the feeding connector 21, the rod antenna 31 and the feeding connector 21 are electrically connected, and only the rod antenna 31 operates in the transmitting and receiving operation mode. At this time, since the lower part of the rod antenna 31 is wrapped with the nonconductive jacket 34, the rod antenna 31 is electrically disconnected from the helical antenna 11.

The rod antenna covers a rod type copper line that is coated with silver, ultra-elastic nickel titanium wire, and a rod type coil spring.

Figure 3:
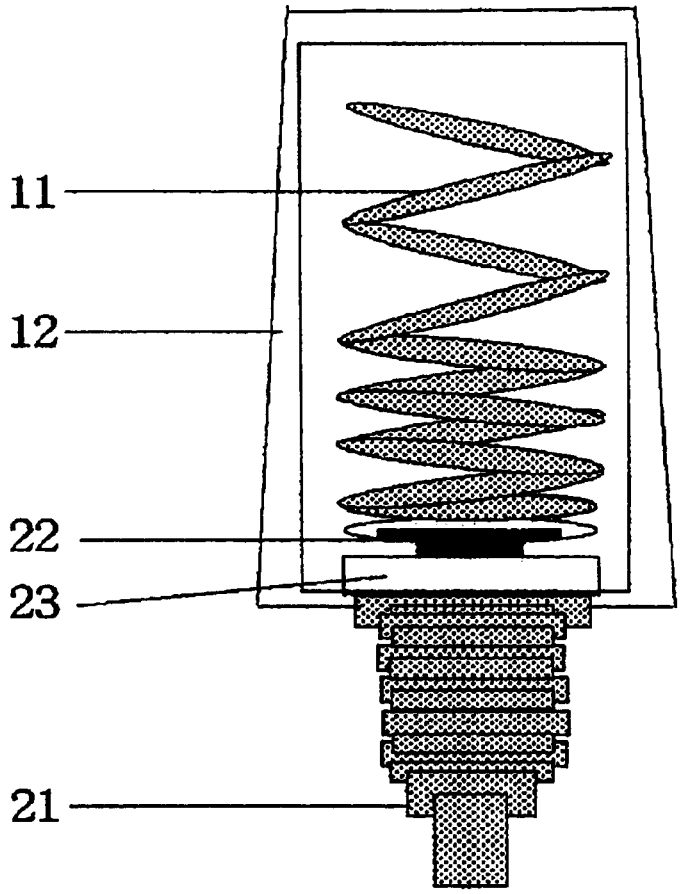
FIG. 3 is a schematic diagram of an antenna housing and a feeding connector.

FIG. 3 shows a schematic diagram of an antenna housing and a feeding connector. The antenna housing comprises a helical antenna 11, a feeding connector 21, an insulation pad 23 which insulates the helical antenna 11 and the feeding connector 21 so as to electrically separate the helical antenna 11 and the feeding connector 21, and a metallic conductive plate 22 which fixes the lower part of the helical antenna 11 on the insulation pad 23. The antenna housing 12 surrounds the helical antenna 11, the metallic conductive plate 22, the insulation pad 23, and some of the upper part of the feeding connector 21. Hence, the helical antenna 11 is insulated from the feeding connector 21.

Figure 4:
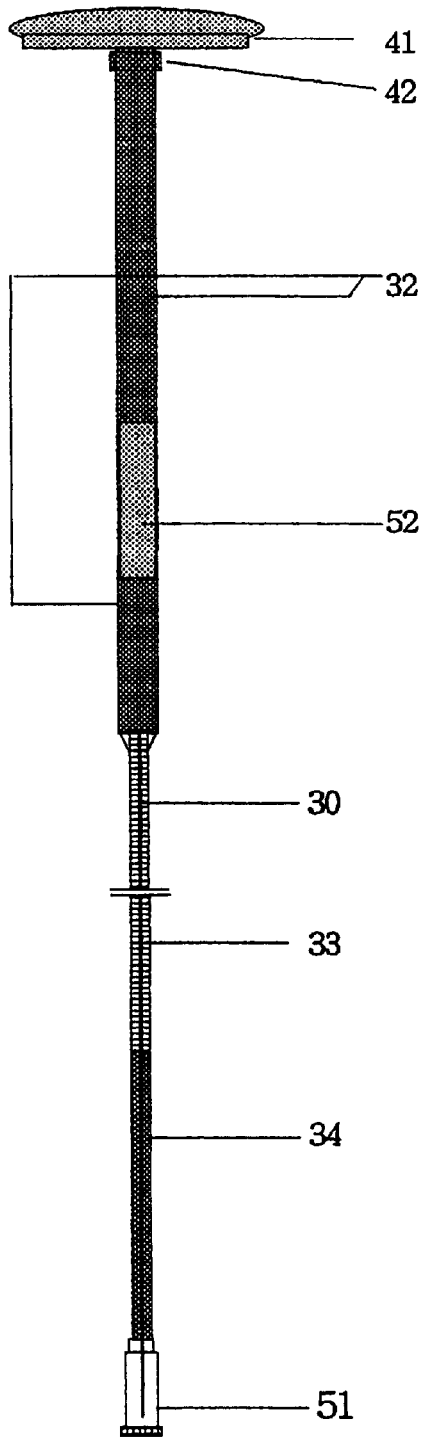
FIG. 4 is a schematic diagram of a rod antenna.

FIG. 4 shows a schematic diagram of a rod antenna.

A cap 41 is installed on the upper part of the rod antenna so as to allow the easy extension and contraction of the rod antenna 31. Furthermore, an embossed reinforcement projection 42 is installed on a connected part of the rod antenna 31 and the cap 41 so as to supplement this easily broken part.

When the metallic conductive ring 52 of the rod antenna 31 is displaced from a predetermined position where the helical antenna 11 is electrically connected to the feeding connector 21, the helical antenna 11 is completely disconnected electrically from the feeding connector 21.

A metallic end terminal 51 is installed on an end of the lower part of the rod antenna 31 so that when the rod antenna 31 is extended, the end terminal 51 stops the rod antenna 31 on the feeding connector 21 and concurrently electrically connects the rod antenna 31 to the feeding connector 21.

Figure 5:
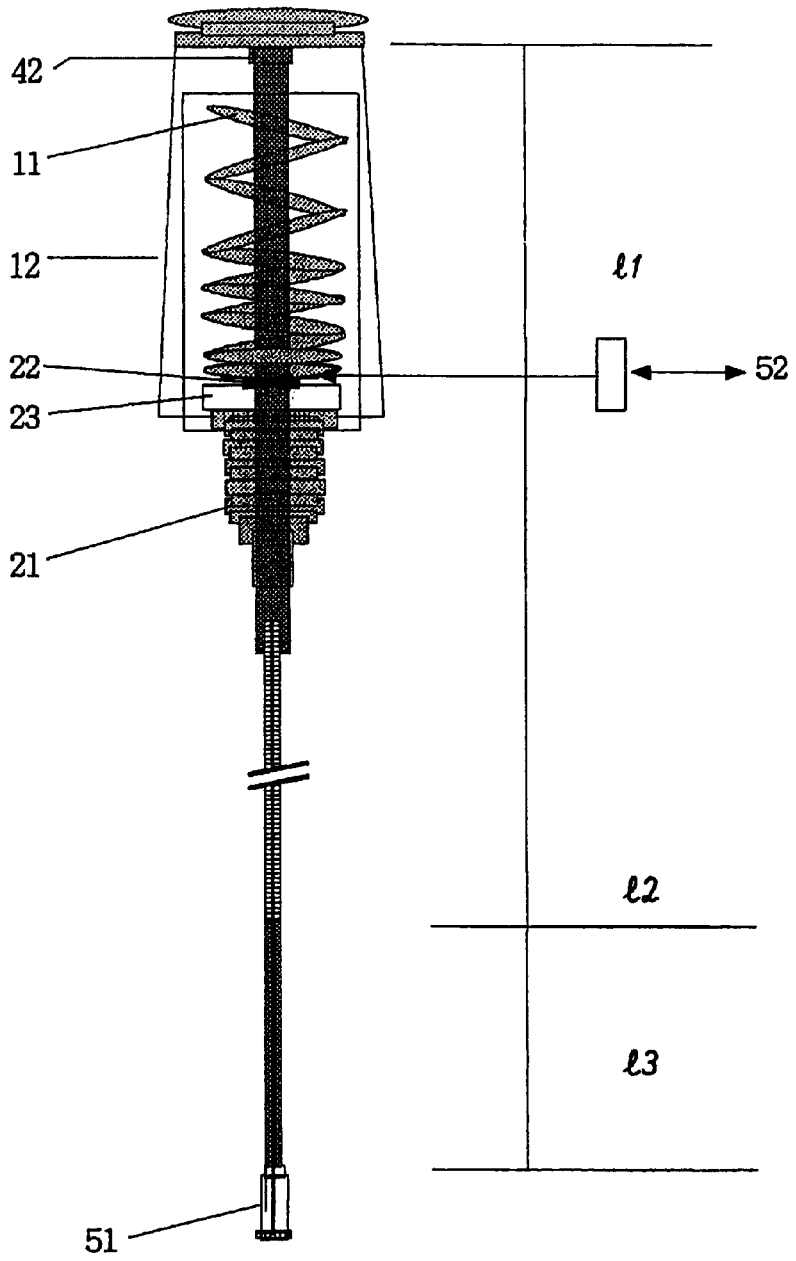
FIG. 5 is a schematic diagram of an antenna apparatus in which a rod antenna is contracted into an inner part of the antenna housing.

FIG. 5 shows a detailed diagram when the rod antenna 31 is contracted into the antenna housing 12. The reference symbol l1 represents an upper section of the rod antenna 31 wrapped with the insulation covering material 32, the reference symbol l2 represents an intermediate section of the rod antenna 31 wrapped with the conductive jacket 33, and the reference symbol l3 represents a lower section of the rod antenna 31 wrapped with the nonconductive jacket 34. The helical antenna 11, metallic conductive plate 22, and feeding connector 21 are electrically connected by the metallic conductive ring 52 of the rod antenna (not illustrated in FIG. 5), while on the other hand, the rod antenna 31 is electrically disconnected with the feeding connector 21. Therefore, the helical antenna 11 performs antenna functions without being affected by the rod antenna 31.

Figure 6:
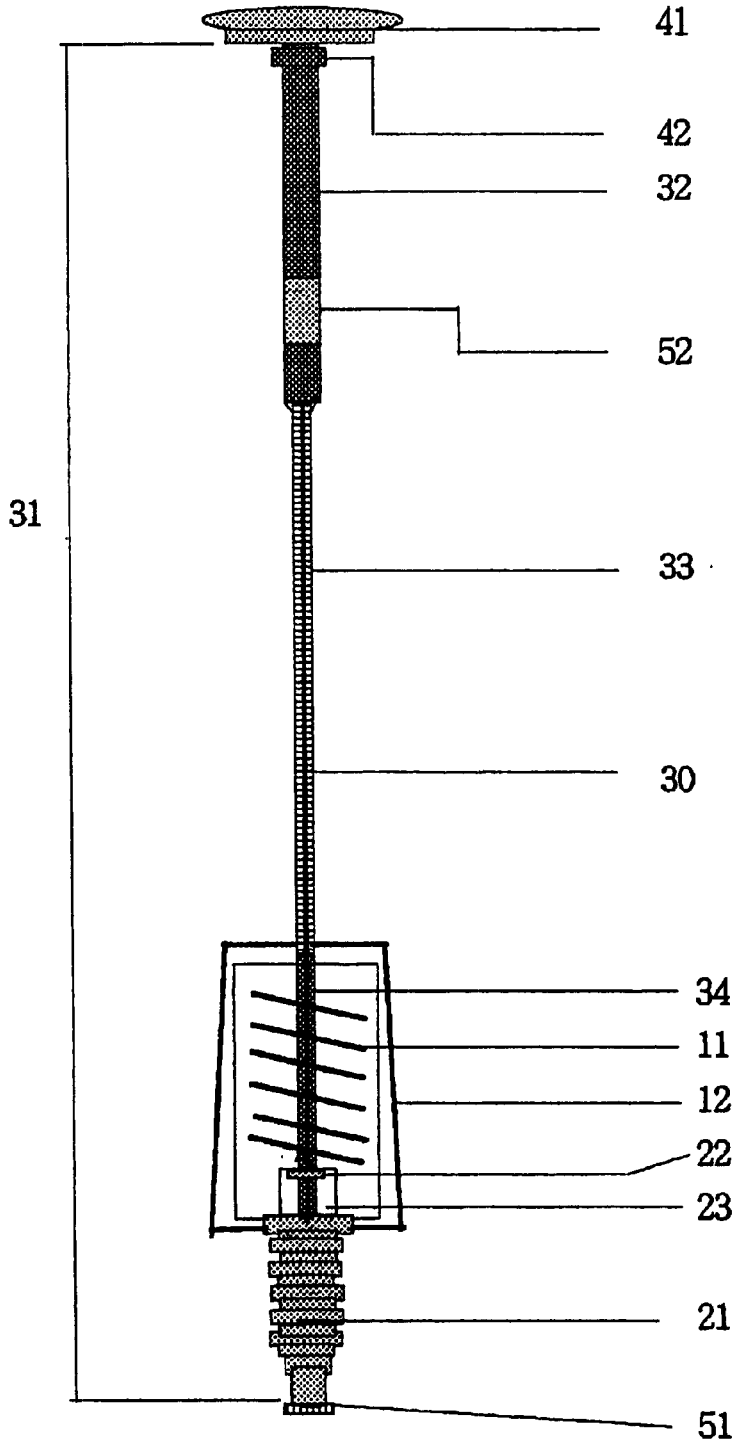
FIG. 6 is a schematic diagram of an antenna apparatus in which a rod antenna is extended outside of the antenna housing.

FIG. 6 shows a detailed schematic diagram in which the rod antenna 31 is extended outside of the antenna housing 12. In this state, the rod antenna 31 is electrically connected to the feeding connector 21 by the metallic end terminal 51, while at the same time the helical antenna 11 is electrically disconnected from the feeding connector 21 because of the movement of the metallic conductive ring 52. Further, since the lower part l3 of the rod antenna 31 positioned in the feeding connector 21 is wrapped with the nonconductive jacket 34, the rod antenna 31 independently performs the antenna functions without being affected by a coupling with the helical antenna 11.

While this invention has been described in connection with what is presently considered to be the most practical and preferred embodiment, it is to be understood that the invention is not limited to the disclosed embodiments. On the contrary, this invention is intended to cover various modifications and equivalent arrangements included within the spirit and scope of the appended claims.

What is claimed is:

1. An antenna of a wireless apparatus, comprising:

an antenna housing fixed on an outer upper part of the wireless apparatus main body;

a feeding connector installed in a lower part of the antenna housing and electrically connected to a circuit board in the wireless apparatus main body;

a helical antenna including a helical coil built in the antenna housing and electrically disconnected from the feeding connector; and a rod antenna moving up and down through the feeding connector and the helical antenna, the rod antenna having an upper part and a lower part, wherein the upper part of the rod antenna with a predetermined length is wrapped with an insulating material, a conductive ring, electrically insulated from the rod antenna, is installed at a predetermined position of the upper part, and an end terminal is installed in the lower part of the rod antenna, wherein when the rod antenna is contracted into the wireless apparatus, the rod antenna is electrically disconnected from the feeding connector, the conductive ring of the rod antenna is connected to the helical antenna and the feeding connector such that the helical antenna is electrically connected to the feeding connector; and when the rod antenna is extended outside of the wireless apparatus, the helical antenna is electrically disconnected from the feeding connector, the end terminal of the rod antenna is connected to the feeding connector and then the rod antenna is electrically connected to the feeding connector.

2. The antenna of claim 1, wherein the helical antenna is electrically disconnected with the feeding connector by an electrically disconnecting means.

3. The antenna of claim 1, wherein the electrically disconnecting means comprises an insulator.

4. The antenna of claim 1, wherein a center part of a predetermined length of the rod antenna is a conductive metallic core rod or a conductive metallic core rod wrapped with a conductive covering material.

5. The antenna of claim 1, wherein a lower part of a predetermined length of the rod antenna is a metallic core rod wrapped with an insulation covering material.

6. The antenna of claim 1, wherein the end terminal stops the rod antenna on a cylindrical spring installed in the feeding connector when the rod antenna is extended, and electrically connects the rod antenna with the feeding connector.

7. The antenna of claim 1, wherein when the rod antenna is contracted into the wireless apparatus, an upper insulation part of the rod antenna passes through the helical antenna and the feeding connector so that the rod antenna is electrically disconnected from the feeding connector.

8. The antenna of claim 5, wherein when the rod antenna is extended, a lower part of the rod antenna which is wrapped with an insulation covering material passes through the helical antenna and the feeding connector so that the helical antenna and the rod antenna are electrically insulated from each other.

9. The antenna of claim 6, wherein when the rod antenna is extended, the end terminal and the feeding connector installed below the rod antenna are electrically connected.

10. The antenna of claim 6, wherein when the rod antenna is extended, a conductive ring moves from a predetermined position of a contraction state and electrically disconnects the helical antenna from the feeding connector.

11. The antenna of claim 2, wherein the helical antenna is connected to the feeding connector in a capacitive manner.

12. The antenna of claim 3, wherein the helical antenna is connected to the feeding connector in a capacitive manner.

13. The antenna of claim 1, wherein the helical antenna comprises helical dual band or multi-bands antennas.

14. The antenna of claim 1, wherein the rod antenna covers a rod type copper line that is coated with silver, ultrelastic nickel titanium wire, and a rod type coil spring.

* * * * *

UNITED STATES PATENT AND TRADEMARK OFFICE

CERTIFICATE OF CORRECTION

PATENT NO. : 6,317,086 B1
DATED : November 13, 2001
INVENTOR(S) : Min-Jae Woo

It is certified that error appears in the above-identified patent and that said Letters Patent is hereby corrected as shown below:

Column 1,
Line 50, "c an b e" should read -- can be --
Line 52, "comprises" should read -- comprising --

Column 3,
Line 28, "multi-bands" should read -- multi-band --
Line 58, "inventor(s)" should read -- inventor --

Column 6,
Line 55, "multi-bands" should read -- multi-band --
Line 58, "ultrelastic" should read -- ultra-elastic --

Signed and Sealed this

Third Day of September, 2002

*Attest:*

*Attesting Officer*

JAMES E. ROGAN
*Director of the United States Patent and Trademark Office*